US010749282B2

(12) United States Patent
Suzuki et al.

(10) Patent No.: US 10,749,282 B2
(45) Date of Patent: Aug. 18, 2020

(54) CARD EDGE CONNECTION UNIT

(71) Applicant: SMK Corporation, Tokyo (JP)

(72) Inventors: Satoru Suzuki, Saitama (JP); Mitsuhiro Yoshida, Kanagawa (JP); Shogo Uehara, Kanagawa (JP); Shinya Okumura, Kanagawa (JP)

(73) Assignee: SMK Corporation, Tokyo (JP)

( * ) Notice: Subject to any disclaimer, the term of this patent is extended or adjusted under 35 U.S.C. 154(b) by 24 days.

(21) Appl. No.: 16/200,672

(22) Filed: Nov. 27, 2018

(65) Prior Publication Data

US 2019/0190176 A1 Jun. 20, 2019

(30) Foreign Application Priority Data

Dec. 14, 2017 (JP) ..... 2017-239277

(51) Int. Cl.
*H01R 24/00* (2011.01)
*H01R 12/72* (2011.01)
(Continued)

(52) U.S. Cl.
CPC ..... *H01R 12/721* (2013.01); *H01R 12/7005* (2013.01); *H01R 12/87* (2013.01);
(Continued)

(58) Field of Classification Search
CPC .. H01R 12/721; H01R 12/7005; H01R 12/87; H01R 12/89; H01R 13/502; H01R 13/6315; H01R 4/18
(Continued)

(56) References Cited

U.S. PATENT DOCUMENTS 4,904,197 A 2/1990 Cabourne
6,238,226 B1 * 5/2001 Schempp ..... H01R 12/87 439/260
(Continued)

FOREIGN PATENT DOCUMENTS

EP 1383204 A1 1/2004
JP H1022008 A 1/1998
(Continued)

OTHER PUBLICATIONS

Office Action issued for counterpart Japanese Application 2017-239277, drafted by the Japan Patent Office dated Apr. 25, 2018.
(Continued)

*Primary Examiner* — Khiem M Nguyen

(57) ABSTRACT

Even when a connection board has a large thickness tolerance, a stable connection is achieved by absorbing the tolerance so as to stabilize a contact pressure between the connection board and contacts. In a unit in which electrode groups of a connection board are in pressure contact with elastic contacts formed integrally with an inner housing to connect thereto, the inner housing is provided inside an outer case of a card edge connector through an elastic member to be freely movable forward and backward in a thickness direction of the connection board. The positions of the elastic contacts are adjusted by forward or backward moving the inner housing in accordance with the thickness of the connection board inserted into board insertion slots, so a pressure contact force with the elastic contacts is substantially equalized, irrespective of the size of the thickness of the connection board.

3 Claims, 5 Drawing Sheets

(51) Int. Cl.

| | |
|---|---|
| ***H01R 13/631*** | (2006.01) |
| ***H01R 12/87*** | (2011.01) |
| ***H01R 12/70*** | (2011.01) |
| ***H01R 12/89*** | (2011.01) |
| ***H01R 13/502*** | (2006.01) |
| *H01R 4/18* | (2006.01) |

(52) U.S. Cl.
CPC ..... *H01R 12/89* (2013.01); *H01R 13/502* (2013.01); *H01R 13/6315* (2013.01); *H01R 4/18* (2013.01)

(58) Field of Classification Search
USPC ..... 439/629, 630
See application file for complete search history.

(56) References Cited

U.S. PATENT DOCUMENTS

| | | | | |
|---|---|---|---|---|
| 6,247,938 | B1 * | 6/2001 | Rathburn | H01R 13/2414 439/66 |
| 10,236,613 | B2 * | 3/2019 | Scherer | H01R 12/721 |
| 2010/0190385 | A1 | 7/2010 | Yamakami | |

FOREIGN PATENT DOCUMENTS

| | | | |
|---|---|---|---|
| JP | 5454608 | B2 | 3/2014 |
| JP | 2015228328 | A | 12/2015 |
| JP | 2016212969 | A | 12/2016 |

OTHER PUBLICATIONS

Extended European Search Report issued for counterpart European Application No. 18209001.9, issued by the European Patent Office dated Apr. 25, 2019.

* cited by examiner

CARD EDGE CONNECTION UNIT

CROSS REFERENCE TO RELATED APPLICATION

The contents of the following Japanese patent application are incorporated herein by reference, Japanese Patent Application No. 2017-239277 filed on Dec. 14, 2017.

FIELD

The present invention relates to a card edge connection unit, in which a connection board of a card edge module is inserted into and connected to a card edge connector, that allows a stable connection by absorbing a thickness tolerance of the connection board.

BACKGROUND

FIG. 6 shows a related unit that electrically connects a memory card 2 to a connector 6 of an electronic device 1 (Patent Literature 1).

In the drawing, when the memory card 2 is inserted into an insertion opening 1*a* of the body of the device 1, the memory card 2 is guided by a slope 3*a* of a projection 3 and is attached to such a position as to be brought into contact with a stopper. In the attached position, the memory card 2 is positioned at a predetermined height, owing to the projection 3. The connector 6, which is formed of conductive rubber, is compressed by a biasing force F2 of a leaf spring 5 more or less through a circuit board 4 into a thickness of T1. A conductive contact surface 6*a* and a conductive contact surface 6*b* of the connector 6 are in pressure contact with a contact group 2*a* of the memory card 2 and a contact group 4*a* of the circuit board 4, respectively, with a pressure contact force F1, to become an electrically connected state.

CITATION LIST

Patent Literature

Patent Literature 1: Japanese Patent Application Laid-Open No. Hei. 10-22008

SUMMARY

Technical Problem

In the related unit illustrated in Patent Literature 1, it is conceivable that the distance between the projection 3 and the connector 6 is set slightly narrower than the thickness of the memory card 2. However, if the memory card 2 has a large thickness tolerance, the biasing force F2 of the leaf spring 5 and the pressure contact force F1 of the connector 6 are applied too strongly, and thereby may cause damage, e.g., exfoliation or the like, between the conductive contact surface 6*a* of the connector 6 and the contact group 2*a* of the memory card 2, when sliding therebetween.

On the contrary, if the thickness tolerance of the memory card 2 is too small, a contact pressure between the conductive contact surface 6*a* of the connector 6 and the contact group 2*a* of the memory card 2 is insufficient, and thereby may cause a contact failure.

The present invention aims at providing a card edge connection unit that allows a stable connection, even if a connection board has a large or small thickness tolerance, by absorbing the tolerance so as to have a constant contact pressure between an electrode surface of the connection board and contacts of a connector.

Solution to Problem

In a card edge connection unit according to one aspect of the present invention, a connection board of a card edge module is inserted into a board insertion slot provided in an inner housing of a card edge connector, to cause an electrode group of the connection board to be brought into pressure contact with an elastic contact, which is integral with the inner housing, to connect thereto, the board insertion slot is configured to have an opening width that is formed smaller than the thickness of the connection board by a minimum tolerance or slightly less, and to have a tapered surface at an opening edge of the board insertion slot to guide the insertion of the connection board, and the inner housing is configured to be provided inside an outer case of the card edge connector through an elastic member so as to be freely movable forward and backward in a thickness direction of the connection board, so that the position of the elastic contact is adjusted by pushing the inner housing open in accordance with the thickness of the connection board to be inserted into the board insertion slot.

In a card edge connection unit according to another aspect of the present invention, a connection board of a card edge module is inserted into a board insertion slot provided in an inner housing of a card edge connector, to cause electrode groups of the connection board to be brought into pressure contact with elastic contacts, which are integral with the inner housing, to connect thereto, the inner housing comprises two inner housings, i.e., an upper inner housing and a lower inner housing, stacked vertically; the board insertion slot is provided between opposite surfaces of the upper inner housing and the lower inner housing; in the upper inner housing and the lower inner housing inside the board insertion slot, the elastic contacts are provided opposite so as to be in pressure contact with the electrode groups on both surfaces of the connection board;

the board insertion slot is configured to have an opening width that is formed smaller than the thickness of the connection board by a minimum tolerance or slightly less, and to have a tapered surface at an opening edge of the board insertion slot to guide the insertion of the connection board;

the upper inner housing and the lower inner housing are configured to be provided inside an outer case of the card edge connector through an upper elastic member and a lower elastic member, respectively, so as to be freely movable forward and backward in a thickness direction of the connection board, so that the positions of the opposite elastic contacts are adjusted by pushing the upper inner housing and the lower inner housing open in accordance with the thickness of the connection board to be inserted into the board insertion slot.

The elastic contact is integrally attached to a crimp terminal that is fixedly secured to each of the upper inner housing and the lower inner housing.

In the card edge connection unit according to the one aspect of the present invention, the connection board of the card edge module is inserted into the board insertion slot provided in the inner housing of the card edge connector, to cause the electrode group of the connection board to be brought into pressure contact with the elastic contact, which is integral with the inner housing, to connect thereto;

the board insertion slot is configured to have the opening width that is formed smaller than the thickness of the connection board by the minimum tolerance or slightly less, and to have the tapered surface at the opening edge of the board insertion slot to guide the insertion of the connection board; and the inner housing is configured to be provided inside the outer case of the card edge connector through the elastic member so as to be freely movable forward and backward in the thickness direction of the connection board, so that the positions of the elastic contacts are adjusted by pushing the inner housing open in accordance with the thickness of the connection board inserted into the board insertion slot. Accordingly, if the thickness of the connection board is within a tolerance range, a pressure contact force to the electrode group of the connection board can be maintained constant irrespective of the size of the thickness of the connection board. Therefore, even if the connection board is thick, exfoliation and the like may not occur, when sliding between the contacts and the electrode group. Even if the connection board is thin, a connection failure may not occur between the contacts and the electrode group. It is thus possible to provide the card edge connection unit that achieves a stable connection. Since the opening width of the board insertion slot is formed smaller than the thickness of the connection board by the minimum tolerance or slightly less, a stable connection can be achieved within the thickness tolerance of the connection board. Furthermore, since the tapered surface is formed at the opening edge of the board insertion slot to guide the insertion of the connection board, the distance between the elastic contacts can be appropriately adjusted, even if the thickness of the connection board varies.

In the card edge connection unit according to the other aspect of the present invention, the connection board of the card edge module is inserted into the board insertion slot provided in the inner housing of a card edge connector, to cause electrode groups of the connection board to be brought into pressure contact with elastic contacts, which are integral with the inner housing, to connect thereto;

the inner housing is comprises two inner housings, i.e., the upper inner housing and the lower inner housing, stacked vertically; the board insertion slot is provided between the opposite surfaces of the upper inner housing and the lower inner housing; in the upper inner housing and the lower inner housing inside the board insertion slot, the elastic contacts are provided opposite so as to be in pressure contact with the electrode groups on both surfaces of the connection board;

the board insertion slot is configured to have the opening width that is formed smaller than the thickness of the connection board by a minimum tolerance or slightly less, and to have the tapered surface at the opening edge of the board insertion slot to guide the insertion of the connection board; and the upper inner housing and the lower inner housing are configured to be provided inside the outer case of the card edge connector through the upper elastic member and the lower elastic member, respectively, so as to be freely movable forward and backward in the thickness direction of the connection board, so that the positions of the opposite elastic contacts are adjusted by pushing the upper inner housing and the lower inner housing open in accordance with the thickness of the connection board to be inserted into the board insertion slot. Thus, even if the connection board has the electrode groups on its both surfaces, it is possible to provide the card edge connection unit that allows a stable connection. Since the opening width of the board insertion slot is formed smaller than the thickness of the connection board by the minimum tolerance or slightly less, a stable connection can be achieved within the thickness tolerance of the connection board. Furthermore, since the tapered surface is formed at the opening edge of the board insertion slot to guide the insertion of the connection board, the distance between the elastic contacts can be appropriately adjusted, even if the thickness of the connection board varies.

According to still another aspect of the present invention, the elastic contacts are integrally attached to the crimp terminal that is fixedly secured to each of the upper inner housing and the lower inner housing. Thus, the card edge connector is configured to be shared irrespective of variations in the thickness of the connection board.

DESCRIPTION OF EMBODIMENTS

Figure 1:
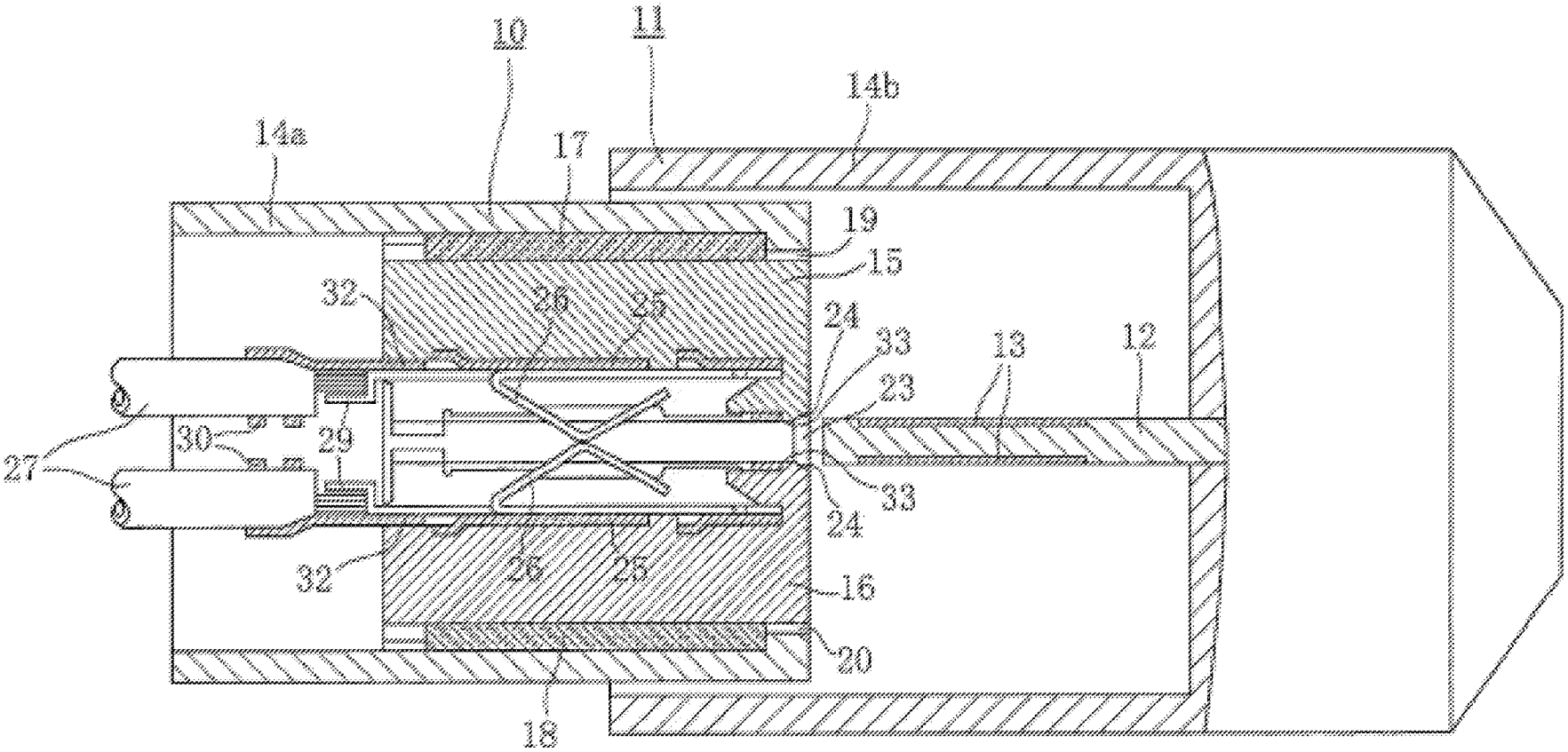
FIG. 1 illustrates a first embodiment of a card edge connection unit according to an embodiment of the present invention, and is a cross-sectional view before a card edge module is inserted into a card edge connector.

In a card edge connection unit according to the one aspect of the present invention, a connection board of a card edge module is inserted into a board insertion slot provided in an inner housing of a card edge connector, to cause an electrode group of the connection board to be brought into pressure contact with an elastic contact, which is integral with the inner housing, to connect thereto;

the board insertion slot is configured to have an opening width that is formed smaller than the thickness of the connection board by a minimum tolerance or slightly less, and to have a tapered surface at an opening edge of the board insertion slot to guide the insertion of the connection board; and the inner housing is configured to be provided inside the outer case of the card edge connector through an elastic member so as to be freely movable forward and backward in the thickness direction of the connection board, so that the positions of the elastic contacts are adjusted by pushing the inner housing open in accordance with the thickness of the connection board to be inserted into the board insertion slot.

In a card edge connection unit according to the other aspect of the present invention, a connection board of a card edge module is inserted into a board insertion slot provided in an inner housing of a card edge connector, to cause electrode groups of the connection board to be brought into pressure contact with elastic contacts, which are integral with the inner housing, to connect thereto;

the inner housing comprises two inner housings, i.e., an upper inner housing and a lower inner housing, stacked vertically; the board insertion slot is provided between opposite surfaces of the upper inner housing and the lower inner housing; in the upper inner housing and the lower inner housing inside the board insertion slot, the elastic contacts are provided opposite so as to be in pressure contact with the electrode groups on both surfaces of the connection board; and the board insertion slot is configured to have an opening width that is formed smaller than the thickness of the connection board by a minimum tolerance or slightly less, and to have a tapered surface at an opening edge of the board insertion slot to guide the insertion of the connection board; and the upper inner housing and the lower inner housing are configured to be provided inside an outer case of the card edge connector through an upper elastic member and a lower elastic member, respectively, so as to be freely movable forward and backward in a thickness direction of the connection board, so that the positions of the opposite elastic contacts are adjusted by pushing the upper inner housing and the lower inner housing open in accordance with the thickness of the connection board inserted into the board insertion slot.

According to the still another aspect of the present invention, the elastic contact is integrally attached to a crimp terminal that is fixedly secured to each of the upper inner housing and the lower inner housing.

First Embodiment

A first embodiment of the present invention will be described below on the basis of the drawings.

In FIGS. 1 to 4, a card edge connector is denoted by reference numeral 10, and a card edge module is denoted by reference numeral 11. The card edge connector 10 and the card edge module 11 constitute a card edge connection unit according to this embodiment of the present invention.

Figure 3:
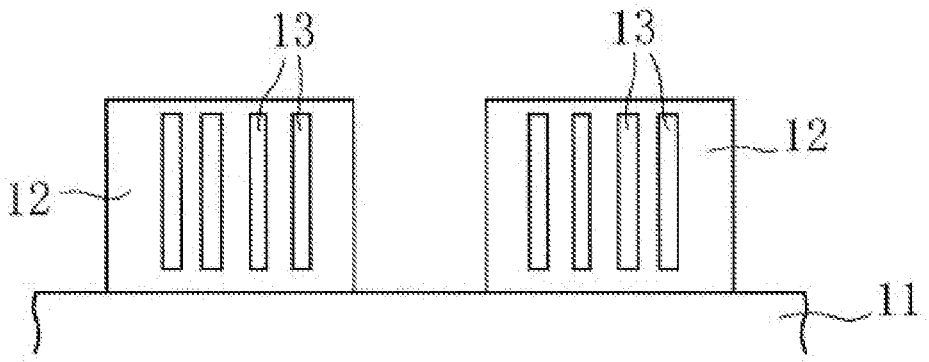
FIG. 3 is a plan view of a connection board of the card edge module of FIG. 1.

In the card edge module 11, a connection board 12 having a predetermined thickness protrudes to an inner middle portion enclosed by an outer case 14*b*. As shown in FIG. 3, electrode groups 13 are provided in both surfaces of the connection board 12.

The connection board 12 is designed so as to have a thickness of, for example, 1.6 mm and an allowable tolerance of ±10%. Even if such a tolerance occurs in the connection board 12, the connection board 12 is desired to be stably and reliably connected to the card edge connector 10, and this embodiment aims at achieving this object.

To achieve this object, the card edge connector 10 is configured as follows.

Figure 2:
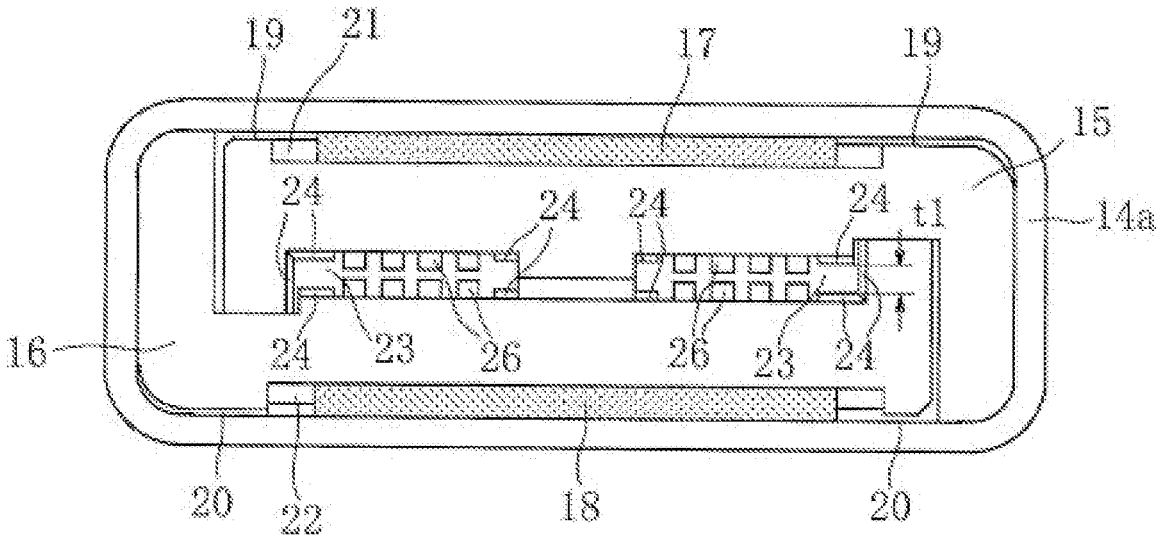
FIG. 2 is a front view of the card edge connector of FIG. 1.

As shown in FIGS. 1 and 2, two inner housings, i.e., an upper inner housing 15 and a lower inner housing 16, formed of a rigid plastic or the like are provided opposite to each other inside an outer case 14*a*, which is opened at both ends. The upper inner housing 15 and the lower inner housing 16 are provided in an upper containment recess 21 and a lower containment recess 22 formed on an inner surface of the outer case 14*a* through an upper elastic member 17 and a lower elastic member 18 formed of a rubber plate or the like, respectively, so as to be freely movable forward and backward in a thickness direction of the connection board 12. Two board insertion slots 23 are formed by cutting out the upper inner housing 15 and the lower inner housing 16 between their opposite surfaces, while the upper inner housing 15 and the lower inner housing 16 are in close contact with each other in a separable manner at a middle portion and both end portions of the board insertion slots 23.

In a state where the upper inner housing 15 and the lower inner housing 16 are contained through the upper elastic member 17 and the lower elastic member 18 while they are in close contact with each other at their opposite surfaces, an upper gap 19 is formed between the upper inner housing 15 and the inner surface of the outer case 14*a*, and a lower gap 20 is formed between the lower inner housing 16 and the inner surface of the outer case 14*a*.

Tapered surfaces 24 are formed at upper and lower surface edges and side surface edges on both ends of the board insertion slots 23, to guide the insertion of the connection board 12. An opening width t1 between inner contact surfaces 33 inside the tapered surfaces 24 at the upper and lower surface edges is set narrower than the thickness of the connection board 12 by the minus thickness tolerance or slightly less. To be more specific, when the thickness of the connection board 12 is represented by T and the tolerance is set at ±10%, the aforementioned t1 can be set to (T−10%) or slightly narrower.

Inside the board insertion slots 23 between the upper inner housing 15 and the lower inner housing 16, crimp terminal containment grooves 32 the number of which corresponds to the number of lines of the electrode group 13 of the connection board 12 are formed opposite to each other. A crimp terminal 25 shown in FIG. 4 is fixedly attached to each of the crimp terminal containment grooves 32. In contact containment portions 28 of a pair of upper and lower crimp terminals 25, elastic contacts 26 are opposite to each other so as to face to each other at one end portion, and contact portions 31 of the elastic contacts 26 are contained with a distance d1. To the other end portion of the crimp terminal 25, a lead wire 27 is securely connected through a lead wire crimp portion 29 and a sheath crimp portion 30.

Figure 4A:
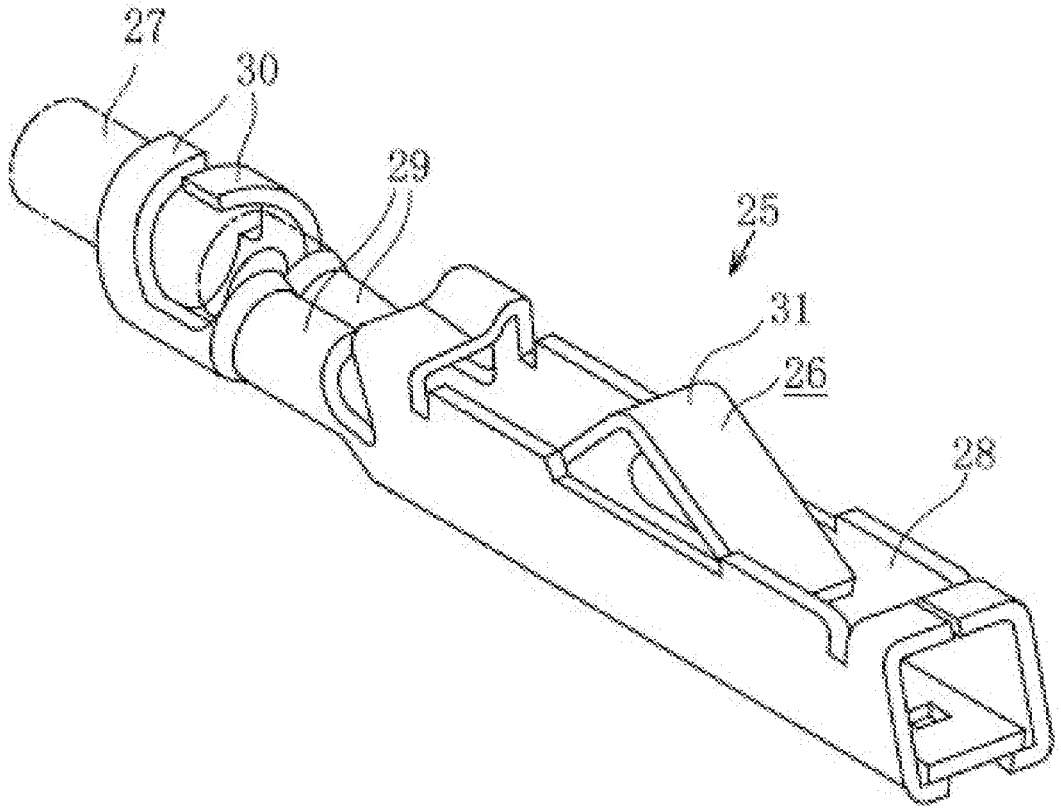
FIG. 4A is a perspective view illustrating an example of a crimp terminal of the card edge connector of FIG. 1 in which a contact portion of an elastic contact is in the shape of an inverted V or a chevron.
Figure 4B:
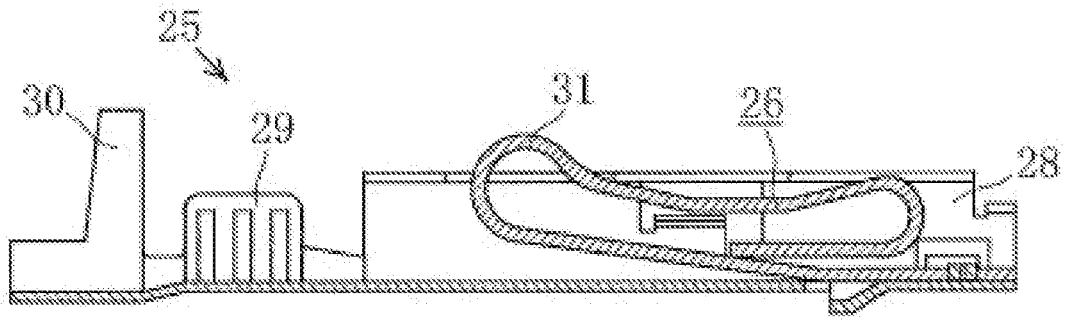
FIG. 4B is a cross-sectional view illustrating another example of a crimp terminal of the card edge connector of FIG. 1 in which the contact portion of the elastic contact is in the shape of an earlobe.
Figure 5:
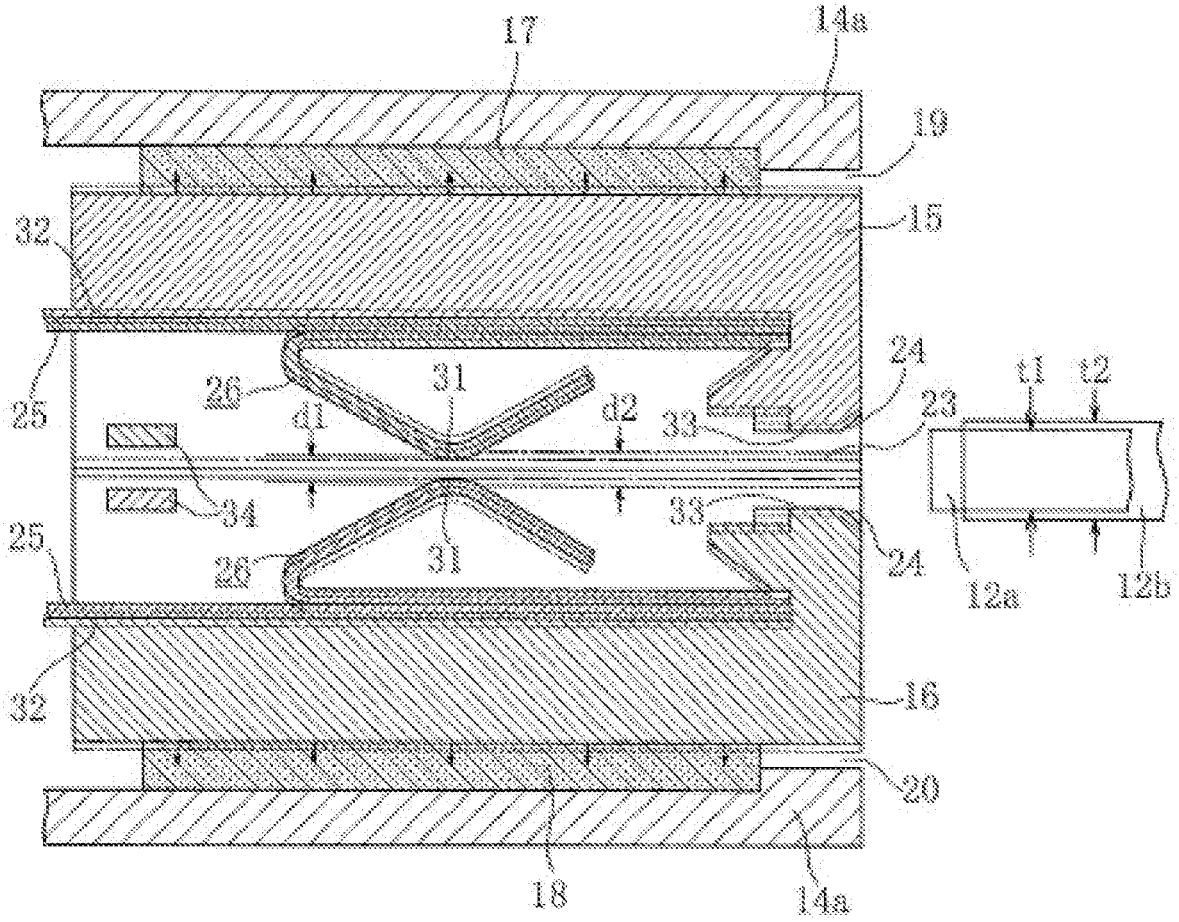
FIG. 5 is a cross-sectional view for explaining the card edge connector, in cases where the connection board of the card edge module has a large thickness tolerance and a small thickness tolerance.
Figure 6:
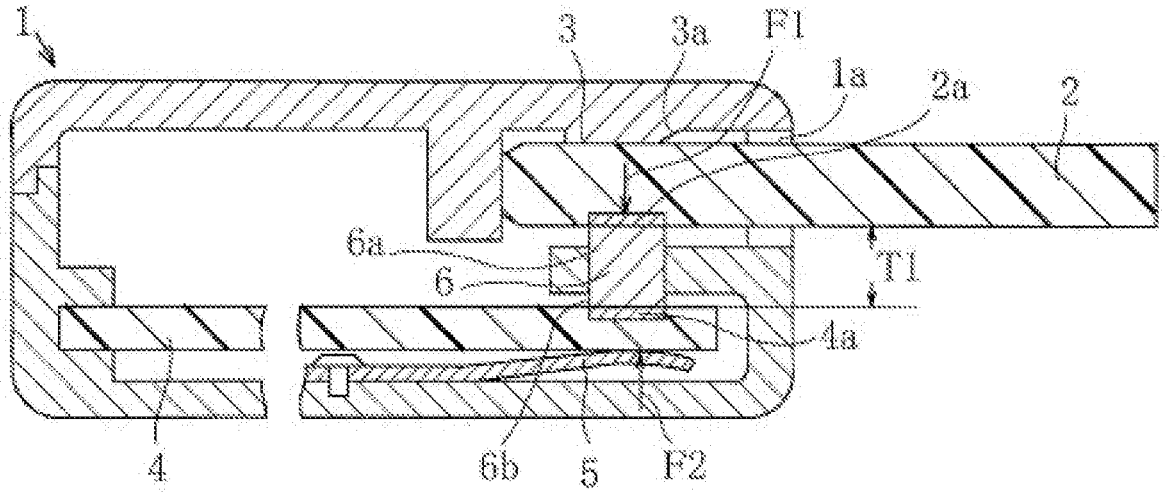
(RELATED ART) FIG. 6
FIG. 6 is a cross-sectional view of a related memory card attachment unit.

The contact portion 31 of the elastic contact 26 is in the shape of an inverted V or a chevron in the example illustrated in FIGS. 1, 4A, and 5, but not limited thereto. As illustrated in FIG. 4B, the contact portion 31 may be in the shape of an ellipse the middle of which is pressed, like an earlobe.

The distance d1 between the pair of upper and lower contact portions 31 is set such that, when the connection board 12 is inserted, the contact portions 31 of the elastic contacts 26 are connected to the electrode groups 13 of the connection board 12 by application of a predetermined pressure contact force therebetween.

The action of the card edge connection unit configured as described above will be described.

In FIG. 5, it is provided that a small tolerance connection board 12*a*, which is the connection board 12 having the thinnest thickness tolerance t1, is inserted into the board insertion slots 23. The small tolerance connection board 12*a* is guided to and inserted into the center of the board insertion slots 23 through the tapered surfaces 24 of the board insertion slots 23. Both surfaces of the small tolerance connection board 12*a* are led between the contact surfaces 33 of the upper inner housing 15 and the lower inner housing 16. Since the distance between the upper and lower contact surfaces 33 is set equal to or slightly narrower than the thickness t1, which is the thickness of the connection board 12 having the thinnest thickness tolerance, the small tolerance connection board 12*a* enters the inside of the card edge connector 10 while hardly pushing the upper inner housing 15 and the lower inner housing 16.

At the time of inserting the small tolerance connection board 12*a* having the thinnest thickness tolerance t1, the inside of the card edge connector 10 is in a state illustrated by solid lines in FIG. 5. When the connection board 12*a* is further inserted and brought into contact with the upper and lower elastic contacts 26 at its distal end, while pushing the elastic contacts 26 open, the upper inner housing 15 and the lower inner housing 16 move upward and downward by compressing the upper elastic member 17 and the lower elastic member 18, respectively. While the elastic contacts 26 are being in contact with the electrode groups 13 on both surfaces, the connection board 12*a* reaches stoppers 34.

As described above, when the small tolerance connection board 12*a* having the thinnest thickness tolerance t1 is inserted, position adjustment is performed such that the contact portions 31 of the upper and lower elastic contacts 26 are in contact with the electrode groups 13 of the small tolerance connection board 12*a* with a predetermined pressure contact force in the state of having a distance d1 between the contact portions 31 of the upper and lower elastic contacts 26.

Next, it is provided that a large tolerance connection board 12*b*, which is the connection board 12 having the thickest thickness tolerance t2, is inserted into the board insertion slots 23. Since the thickness t2 of the large tolerance connection board 12*b* is thicker than the distance t1 between the upper and lower contact surfaces 33, the large tolerance connection board 12*b* is in contact with the tapered surfaces 24 at its distal end, and is inserted, while pushing the upper inner housing 15 and the lower inner housing 16 open. When the upper inner housing 15 and the lower inner housing 16 are pushed upward and downward, respectively, the upper elastic member 17 moves to the direction of the upper gap 19 by being compressed by the upper inner housing 15, and the lower elastic member 18 moves to the direction of the lower gap 20 by being compressed by the lower inner housing 16, into a state illustrated by chain double-dashed lines in FIG. 5. By the upward and downward movement of the upper inner housing 15 and the lower inner housing 16, the integrally attached pair of elastic contacts 26 also move upward and downward, respectively. Since the elastic contacts 26 are opened by the thickness tolerance of the large tolerance connection board 12*b*, the distance between the contact portions 31 of the upper and lower elastic contacts 26 is increased to d2.

As described above, when the large tolerance connection board 12*b* having the thickest thickness tolerance t2 is inserted, position adjustment is performed such that the upper and lower elastic contacts 26 are in contact with the electrode groups 13 of the large tolerance connection board 12*b* with a predetermined pressure contact force in the state of having a distance of d2 between the upper and lower elastic contacts 26.

Therefore, the relationship between the thickness of the connection board 12 and the distance between the upper and lower elastic contacts 26 is represented by the following equation.

$$t1-d1=t2-d2$$

Accordingly, if the thickness of the connection board 12 is within a tolerance range, the positions of the upper and lower elastic contacts 26 are adjusted such that the pressure contact force of the elastic contacts 26, at the time of inserting the connection board 12, is substantially equalized.

The compression amount of the upper elastic member 17 and the lower elastic member 18, owing to the upward and downward movement amount of the upper inner housing 15 and the lower inner housing 16, is not completely proportional between cases where the connection board 12 has a small thickness tolerance and a large thickness tolerance. However, since the difference in the movement amount of the upper inner housing 15 and the lower inner housing 16 is slight within the range of the thickness tolerance of the connection board 12, it is considered that the aforementioned equation substantially holds true.

Second Embodiment

The aforementioned embodiment has described a case where the connection board 12 has the electrode groups 13 in its both surfaces, and so the card edge connector 10 has the pairs of elastic contacts 26 to make contact with the electrode groups 13 on both surfaces, by way of example.

However, it is not limited to this example, and when the connection board 12 has the electrode groups 13 on its one surface, the card edge connector 10 may have the elastic contacts 26 to make contact with the electrode groups 13 on the one surface. For example, when the elastic contacts 26 are provided only on the side of the lower inner housing 16, the lower elastic member 18 is attached between the lower inner housing 16 and the outer case 14*a*, but the elastic contacts 26 and the upper elastic member 17 may not be provided on the side of the upper inner housing 15, and the insertion of the connection board 12 may not move the upper inner housing 15.

In the above embodiments, the upper inner housing 15 and the upper elastic member 17 are formed independently, and the lower inner housing 16 and the lower elastic member 18 are formed independently, but may be formed integrally.

REFERENCE SIGNS LIST

10 card edge connector
11 card edge module
12 connection board
13 electrode group
14*a*, 14*b* outer case
15 upper inner housing
16 lower inner housing
17 upper elastic member
18 lower elastic member
19 upper gap
20 lower gap
21 upper containment recess
22 lower containment recess
23 board insertion slot
24 tapered surface
25 crimp terminal
26 elastic contact
27 lead wire
28 contact containment portion
29 lead wire crimp portion
30 sheath crimp portion
31 contact portion
32 crimp terminal containment groove
33 contact surface

The invention claimed is:

1. A card edge connection unit, wherein a connection board of a card edge module is inserted into a board insertion slot provided in an inner housing of a card edge connector, to cause an electrode group of the connection board to be brought into pressure contact with an elastic contact, which is integral with the inner housing, to connect thereto, the board insertion slot is configured to have an opening width that is formed smaller than a thickness of the connection board by a minimum tolerance or slightly less, and to have a tapered surface at an opening edge of the board insertion slot to guide insertion of the connection board, and the inner housing is configured to be provided inside an outer case of the card edge connector through an elastic member so as to be freely movable forward and backward in a thickness direction of the connection board, so that a position of a pivot point of the elastic contact is adjusted by pushing the inner housing open in proportion to the thickness of the connection board to be inserted into the board insertion slot.

2. A card edge connection unit, wherein a connection board of a card edge module is inserted into a board insertion slot provided in an inner housing of a card edge connector, to cause electrode groups of the connection board to be brought into pressure contact with elastic contacts, which are integral with the inner housing, to connect thereto, the inner housing comprises an upper inner housing and a lower inner housing stacked vertically; the board insertion slot is provided between opposite surfaces of the upper inner housing and the lower inner housing; in the upper inner housing and the lower inner housing inside the board insertion slot, the elastic contacts are provided opposite so as to be in pressure contact with the electrode groups on both surfaces of the connection board;

the board insertion slot is configured to have an opening width that is formed smaller than a thickness of the connection board by a minimum tolerance or slightly less, and to have a tapered surface at an opening edge of the board insertion slot to guide insertion of the connection board;

the upper inner housing and the lower inner housing are configured to be provided inside an outer case of the card edge connector through an upper elastic member and a lower elastic member, respectively, so as to be freely movable forward and backward in a thickness direction of the connection board, so that positions of respective pivot points of the opposite elastic contacts are adjusted by pushing the upper inner housing and the lower inner housing open in proportion to the thickness of the connection board to be inserted into the board insertion slot.

3. The card edge connection unit according to claim 2, wherein the elastic contacts are integrally attached to a crimp terminal that is fixedly secured to each of the upper inner housing and the lower inner housing.

* * * * *